US009685746B2

(12) United States Patent
Yu et al.

(10) Patent No.: US 9,685,746 B2
(45) Date of Patent: Jun. 20, 2017

(54) PLUG CONNECTOR, SOCKET CONNECTOR, AND CONNECTOR ASSEMBLY WITH THE PLUG CONNECTOR AND SOCKET CONNECTOR

(71) Applicants: HONG FU JIN PRECISION INDUSTRY (WuHan) CO., LTD., Wuhan (CN); HON HAI PRECISION INDUSTRY CO., LTD., New Taipei (TW)

(72) Inventors: Hui Yu, Wuhan (CN); Si-Xiang Zhu, Wuhan (CN); Lu Jiang, Wuhan (CN)

(73) Assignees: HONG FU JIN PRECISION INDUSTRY (WuHan) CO., LTD., Wuhan (CN); HON HAI PRECISION INDUSTRY CO., LTD., New Taipei (TW)

( * ) Notice: Subject to any disclaimer, the term of this patent is extended or adjusted under 35 U.S.C. 154(b) by 160 days.

(21) Appl. No.: 14/682,578

(22) Filed: Apr. 9, 2015

(65) Prior Publication Data

US 2016/0218458 A1 Jul. 28, 2016

(30) Foreign Application Priority Data

Jan. 26, 2015 (CN) ..... 2015 1 0037768

(51) Int. Cl.

*H01R 13/502* (2006.01)
*H01R 24/62* (2011.01)
*H01R 13/631* (2006.01)

(52) U.S. Cl.

CPC ..... *H01R 24/62* (2013.01); *H01R 13/631* (2013.01)

(58) Field of Classification Search

CPC ..... H01R 23/025; H01R 23/005; H01R 13/6658; H01R 23/7073; H01R 23/02; H01R 23/725; H01R 13/26; H01R 13/658
USPC ..... 439/676, 660, 352, 354, 357–358, 344
See application file for complete search history.

(56) References Cited

U.S. PATENT DOCUMENTS 6,875,027 B2 * 4/2005 Ye ..... H01R 13/627 439/345
7,686,659 B2 * 3/2010 Peng ..... H01R 12/725 439/660
8,133,078 B2 * 3/2012 Lin ..... H01R 12/712 439/218

* cited by examiner

*Primary Examiner* — Edwin A. Leon
(74) *Attorney, Agent, or Firm* — Steven Reiss

(57) ABSTRACT

A plug connector includes a case and a securing portion located in the case. The case is configured to receive a coupling end of a socket connector and includes two opposite sidewalls. The securing portion has a plurality of resilient pins configured to electronically couple to the socket connector. An inner surface of each sidewall is configured to abut against a side surface of the coupling end. Each sidewall defines a positioning slot extending outwardly from the inner surface of the sidewall. The positioning slot is configured to engage a positioning block extending from the coupling end. A socket connector matched to the plug connector and a connector assembly including the plug connector and the socket connector are further provided.

16 Claims, 3 Drawing Sheets

PLUG CONNECTOR, SOCKET CONNECTOR, AND CONNECTOR ASSEMBLY WITH THE PLUG CONNECTOR AND SOCKET CONNECTOR

FIELD

The subject matter herein generally relates to a connector assembly including a plug connector and a socket connector.

BACKGROUND

Socket connectors, such as USB 3.0 jacks, and plug connectors, such as USB 3.0 plugs, are connected together by a number of tuning fork contacts.

BRIEF DESCRIPTION OF THE DRAWINGS

Implementations of the present technology will now be described, by way of example only, with reference to the attached figures.

DETAILED DESCRIPTION

Figure 1:
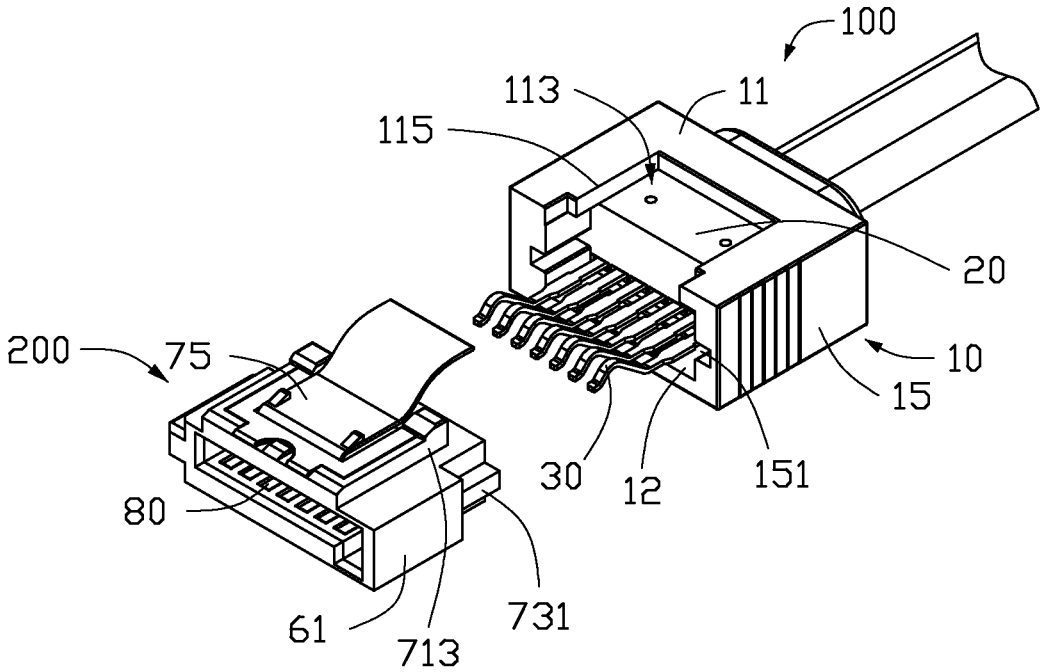
FIG. 1 is an isometric view of an embodiment of a connector assembly including a plug connector and a socket connector.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "substantially" is defined to be essentially conforming to the particular dimension, shape or other feature that the term modifies, such that the component need not be exact. For example, "substantially cylindrical" means that the object resembles a cylinder, but can have one or more deviations from a true cylinder. The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series and the like.

Figure 2:
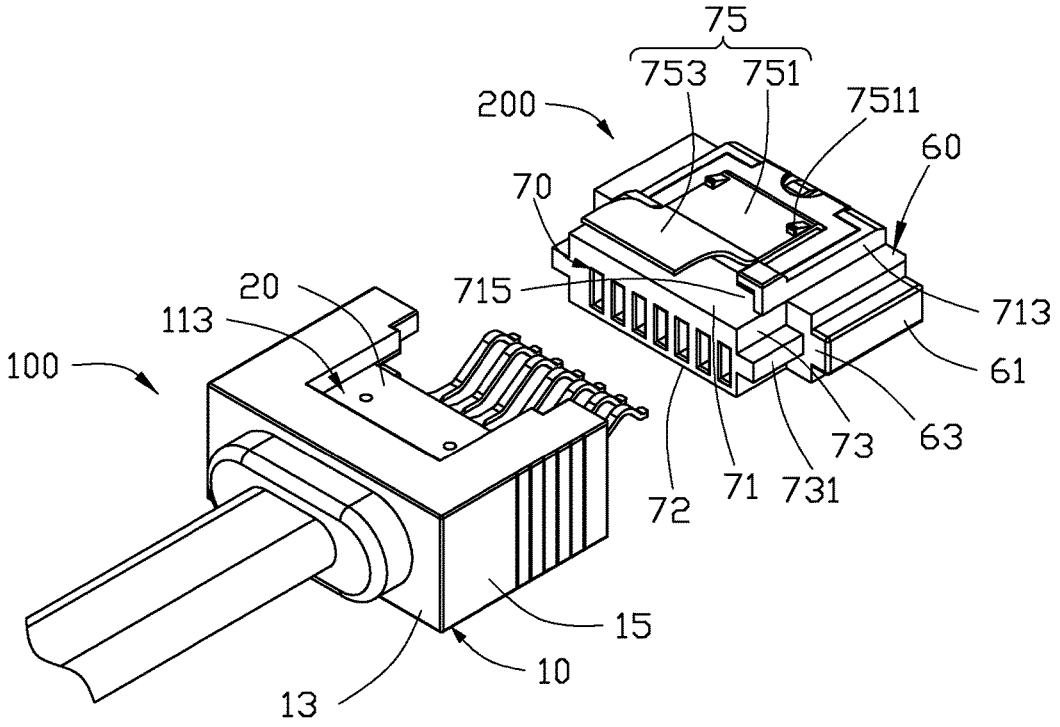
FIG. 2 is similar with FIG. 1, but viewed from a different angle.

FIG. 1 and FIG. 2 illustrate a connector assembly including a plug connector 100 and a socket connector 200 in accordance with an embodiment.

The plug connector 100 can include a case 10 and a securing portion 20 located on the case 10.

The case 10 can include a top wall 11, a bottom wall 12, a rear wall 13, and two opposite sidewalls 15. In at least one embodiment, the rear wall 13 is substantially perpendicular to the top wall 11 and the bottom wall 12, and each sidewall 15 is substantially perpendicular to the top wall 11 and the rear wall 13. The top wall 11 defines a step-shaped cutout 113, and two limiting blocks 115 are located on opposite edges of the cutout 113. Each sidewall 15 defines a positioning slot 151 extending from an inner surface of the sidewall 15 to an outer surface of the sidewall 15. In at least one embodiment, the positioning slot 151 is rectangular.

The securing portion 20 extends from the rear wall 13. A plurality of resilient pins 30 is secured to the securing portion 20 and extends out of the case 10. In one embodiment, the plurality of resilient pins 30 can be coupled to a USB 2.0 socket or a USB 3.0 socket.

The socket connector 200 can include a connection end 60 and a coupling end 70 connected to the connection end 60.

The coupling end 70 can include a top plate 71, a bottom plate 72, and two opposite side plates 73. In at least one embodiment, the top plate 71 is substantially parallel to the bottom plate 72, and each side plate 73 is substantially perpendicular to the top plate 71. A plurality of coupling pins 80 is secured to a bottom surface of the bottom plate 72 facing the top plate 71. A positioning block 731 extends outwardly from each side plate 73. Two latching portions 713 extend from the top plate 71. Each latching portion 713 defines a latching slot 715. In at least one embodiment, the latching portion 713 is substantially "L" shaped. An installation portion 75 is secured between the two latching portions 713. The installation portion 75 can include a resilient piece 751 and an operation piece 753 extending from an edge of the resilient piece 751. In at least one embodiment, the operation piece 753 is cambered. Two latching blocks 7511 extend from the resilient piece 751. The installation portion 75 is configured to secure the socket connector 200 to a circuit board (not shown). The operation portion 753 is operable to elastically deform the resilient piece 751, disengaging the installation portion 75 from the circuit board.

The connection end 60 can include two side boards 61. The two boards 61 are substantially parallel to each other. A distance between the two boards 61 is greater than a distance between the two side plates 73. Each board 61 is coupled to each side plate 73 through a connection board 63. The connection board 63 is substantially perpendicular to the side plate 73 and the board 61. The positioning block 731 extends to the connection board 63.

In at least one embodiment, the socket connector 200 can be a USB 2.0 socket or a USB 3.0 socket.

Figure 3:
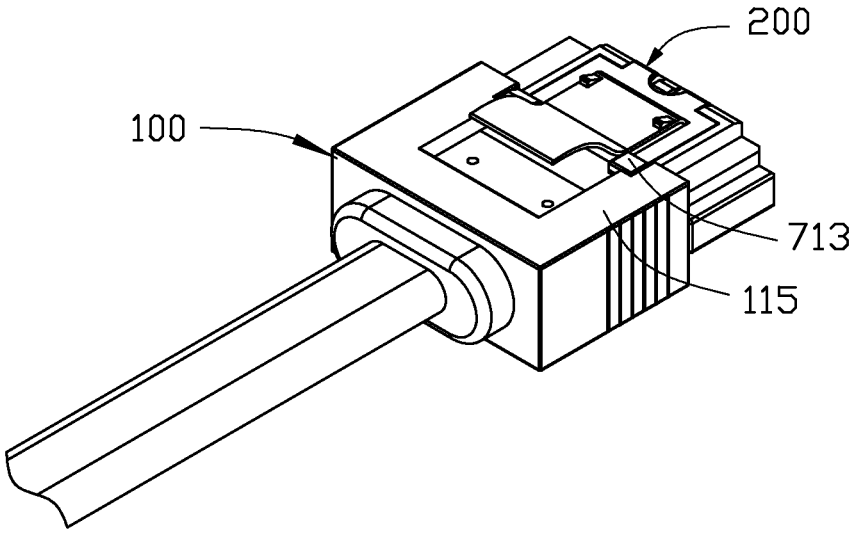
FIG. 3 is an assembled, isometric view of the connector assembly of FIG. 1.

FIG. 3 illustrates that in assembly, the plug connector 100 is moving towards the socket connector 200, until the coupling end 70 is adjacent to the plug connector 100. The top plate 71 abuts against the top wall 11, the bottom plate 72 abuts against the bottom wall 12, and the positioning block 731 is aligned with the positioning slot 151. The coupling end 70 is inserted into the plug connector 100, until the connection board 63 is blocked by the sidewall 15. The side plate 73 abuts against an inner surface of the sidewall 15. The positioning block 731 is engaged in the positioning slot 151. The limiting block 115 is engaged in the latching slot 715. The connection end 60 abuts the plug connector 100. The plurality of resilient pins 30 resists the plurality of coupling pins 80. The bottom plate 72 is received between the installation plate 21 and the bottom wall 12. The positioning block 731 is engaged in the positioning slot 151, and the limiting block 115 is engaged in the latching slot 715 prevent the plug connector 100 from moving relative to the socket connector 200.

The embodiments shown and described above are only examples. Many details are often found in the art such as the other features of a plug connector, a socket connector, and a connector assembly including the plug connector and the socket connector. Therefore, many such details are neither shown nor described. Even though numerous characteristics and advantages of the present technology have been set forth in the foregoing description, together with details of the structure and function of the present disclosure, the disclosure is illustrative only, and changes may be made in the details, including in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A socket connector, comprising:

a coupling end configured to couple to a plug connector and comprising two opposite side plates and a positioning block extending outwardly from a side surface of each side plate; and a plurality of coupling pins located in the coupling end and configured to electronically couple to the plug connector;

a top plate coupled to the two side plates;

a latching portion located on the top plate; and an elastically deformable installation portion attached to the top plate;

wherein each side plate is configured to abut against an inner surface of a sidewall of the plug connector; and the positioning block is configured to engage a positioning slot defined in the inner surface of each sidewall, the top plate is substantially perpendicular to each side plate, the latching portion defines a latching slot, and the latching slot is configured to engage with a limiting block extending from an edge of a cutout, which is defined in a top wall of the plug connector, the installation portion comprises a resilient piece and an operation piece extending from an edge of the resilient piece, two latching blocks extend from the resilient piece, and the two latching blocks are configured to secure the socket connector to a circuit board; and the operation piece is operable to elastically deform the resilient piece, to disengage the installation portion from the circuit board.

2. The socket connector of claim 1, wherein the latching portion is substantially L-shaped.

3. The socket connector of claim 1, wherein the operation piece is cambered.

4. The socket connector of claim 1, further comprising a connection end coupled to the coupling end, wherein the coupling end comprises two boards substantially parallel to each side plate; a distance between the two boards is greater than a distance between the two side plates; each board is coupled to each side plate through a connection board, the connection board is substantially perpendicular to the side plate and the board, and the positioning block extends to the connection board; and the connection board is configured to abut the sidewall of the plug connector.

5. A connector assembly, comprising:

a plug connector, comprising:

a case comprising two opposite sidewalls; and a securing portion located in the case and having a plurality of resilient pins secured thereon, and the plurality of resilient pins are configured to electronically couple to the socket connector; and a socket connector, comprising:

a coupling end comprising two opposite side plates and a positioning block extending from a side surface of each side plate; and a plurality of coupling pins located in the coupling end; and a connection end coupled to the coupling end;

wherein the coupling end is received in the case, and the plurality of resilient pins are electronically coupled to the plurality of coupling pins; a side surface of each side plate abuts against an inner surface of each sidewall; the inner surface of each sidewall defines a positioning slot extending towards an outer surface of the sidewall; and the positioning block is engaged in the positioning slot, the coupling end comprises two boards substantially parallel to each side plate; a distance between the two boards is greater than a distance between the two side plates; each board is coupled to each side plate through a connection board, the connection board is substantially perpendicular to the side plate and the board, and the positioning block extends to the connection board; and the connection board abuts the sidewall of the plug connector.

6. The connector assembly of claim 5, wherein the plug connector further comprises a top wall coupled to the two sidewalls, the top wall is substantially perpendicular to each sidewall and defines a cutout, and a limiting block extends from an edge of the cutout; the socket connector further comprises a top plate coupled to the two side plates and a latching portion located on the top plate, the top plate is substantially perpendicular to each side plate, and the latching portion defines a latching slot; and the limiting block is engaged in the latching slot.

7. The connector assembly of claim 6, wherein the latching portion is substantially L-shaped.

8. The connector assembly of claim 6, wherein the cutout is step-shaped.

9. The connector assembly of claim 6, wherein the positioning slot is substantially rectangular.

10. The connector assembly of claim 5, the socket connector further comprising an elastically deformable installation portion attached to the top plate, wherein the installation portion comprises a resilient piece and an operation piece extending from an edge of the resilient piece, two latching blocks extend from the resilient piece, and the two latching blocks are configured to secure the socket connector to a circuit board; and the operation piece is operable to elastically deform the resilient piece, to disengage the installation portion from the circuit board.

11. The connector assembly of claim 10, wherein the operation piece is cambered.

12. A socket connector, comprising:

a coupling end configured to couple to a plug connector and comprising two opposite side plates and a positioning block extending outwardly from a side surface of each side plate; and a plurality of coupling pins located in the coupling end and configured to electronically couple to the plug connector; and a connection end coupled to the coupling end;

wherein each side plate is configured to abut against an inner surface of a sidewall of the plug connector; and the positioning block is configured to engage a positioning slot defined in the inner surface of each sidewall, the coupling end comprises two boards substantially parallel to each side plate; a distance between the two boards is greater than a distance between the two side plates; each board is coupled to each side plate through a connection board, the connection board is substantially perpendicular to the side plate and the board, and the positioning block extends to the connection board; and the connection board is configured to abut the sidewall of the plug connector.

13. The socket connector of claim 12, further comprising a top plate coupled to the two side plates and a latching portion located on the top plate, wherein the top plate is substantially perpendicular to each side plate, the latching portion defines a latching slot, and the latching slot is configured to engage with a limiting block extending from an edge of a cutout, which is defined in a top wall of the plug connector.

14. The socket connector of claim 13, wherein the latching portion is substantially L-shaped.

15. The socket connector of claim 13, further comprising an elastically deformable installation portion attached to the top plate, wherein the installation portion comprises a resilient piece and an operation piece extending from an edge of the resilient piece, two latching blocks extend from the resilient piece, and the two latching blocks are configured to secure the socket connector to a circuit board; and the operation piece is operable to elastically deform the resilient piece, to disengage the installation portion from the circuit board.

16. The socket connector of claim 15, wherein the operation piece is cambered.

* * * * *